US009915161B2

(12) United States Patent
Blekkenhorst

(10) Patent No.: US 9,915,161 B2
(45) Date of Patent: Mar. 13, 2018

(54) PROCESS GAS COMPRESSOR/GAS TURBINE SECTION

(71) Applicant: SIEMENS AKTIENGESELLSCHAFT, München (DE)

(72) Inventor: Henk Blekkenhorst, Vriezenveen (NL)

(73) Assignee: SIEMENS AKTIENGESELLSCHAFT (DE)

( * ) Notice: Subject to any disclaimer, the term of this patent is extended or adjusted under 35 U.S.C. 154(b) by 308 days.

(21) Appl. No.: 14/437,836

(22) PCT Filed: Sep. 25, 2013

(86) PCT No.: PCT/EP2013/069921
§ 371 (c)(1),
(2) Date: Apr. 23, 2015

(87) PCT Pub. No.: WO2014/063893
PCT Pub. Date: May 1, 2014

(65) Prior Publication Data

US 2015/0292346 A1 Oct. 15, 2015

(30) Foreign Application Priority Data

Oct. 25, 2012 (DE) ..... 10 2012 219 520

(51) Int. Cl.
*F01D 5/08* (2006.01)
*F01D 11/06* (2006.01)
(Continued)

(52) U.S. Cl.
CPC ..... *F01D 11/06* (2013.01); *F01D 15/08* (2013.01); *F04D 17/12* (2013.01); *F04D 17/122* (2013.01);
(Continued)

(58) Field of Classification Search
CPC ..... F01D 11/06; F01D 15/08; F01D 11/04; F04D 17/12; F04D 17/122; F04D 25/02;
(Continued)

(56) References Cited

U.S. PATENT DOCUMENTS

2010/0254811 A1 10/2010 Grosso
2012/0038112 A1 2/2012 Czechowski
(Continued)

FOREIGN PATENT DOCUMENTS

CN 1121740 A 5/1996
CN 1892110 A 1/2007
(Continued)

OTHER PUBLICATIONS

DE4239586C1 Description—English translation (Machine).*
(Continued)

*Primary Examiner* — Woody Lee, Jr.
*Assistant Examiner* — Sabbir Hasan
(74) *Attorney, Agent, or Firm* — Schmeiser Olsen & Watts LLP

(57) ABSTRACT

A process gas compressor/gas turbine section including a process gas compressor and a gas turbine which is coupled to the shaft of the process gas compressor in order to drive said compressor is provided. The process gas compressor is designed to compress combustible process gas and is equipped to seal the process gas compressor inner chamber from the atmosphere using a shaft seal which can be sealed with a seal gas and which has at least one leakage line. The leakage line can conduct leakage gas away from the shaft seal and is connected to the air inlet of the gas turbine such that the leakage gas together with the inlet air at the air inlet can be conducted into the gas turbine during the operation of the process gas compressor/gas turbine section.

8 Claims, 1 Drawing Sheet

Figure 1:
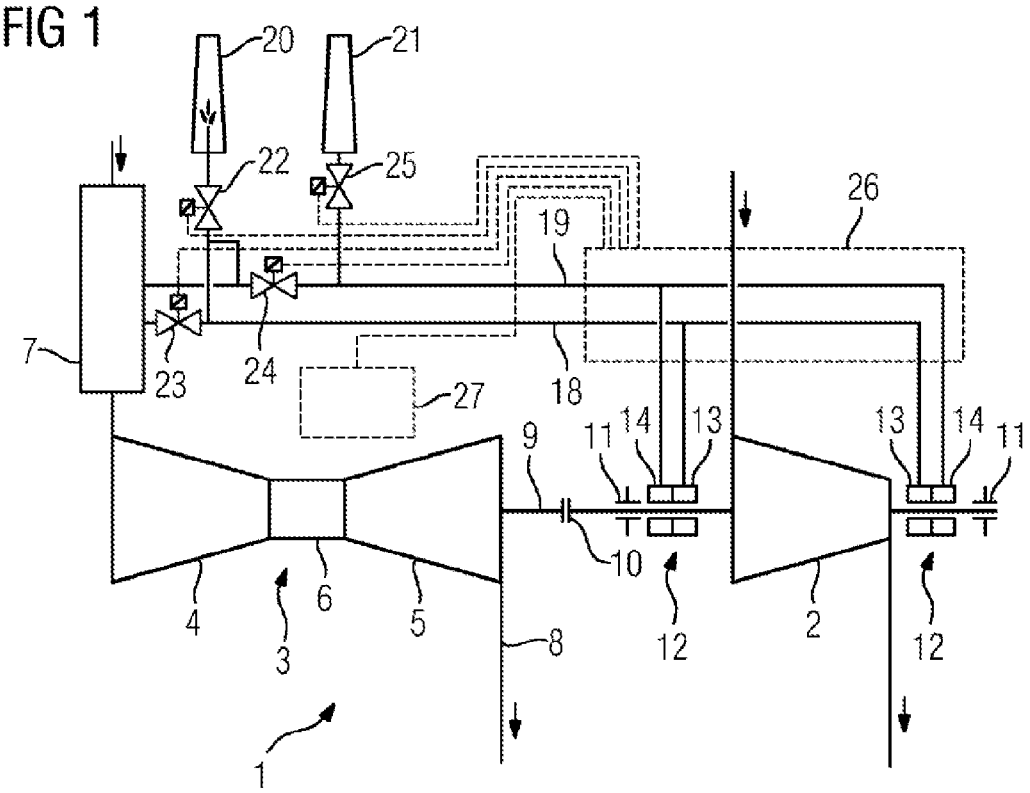

(51) Int. Cl.

| | |
|---|---|
| ***F01D 15/08*** | (2006.01) |
| ***F04D 29/12*** | (2006.01) |
| ***F04D 19/02*** | (2006.01) |
| ***F04D 25/02*** | (2006.01) |
| ***F04D 17/12*** | (2006.01) |

(52) U.S. Cl.
CPC ..... *F04D 19/02* (2013.01); *F04D 25/02* (2013.01); *F04D 29/124* (2013.01); *F05D 2260/6022* (2013.01)

(58) Field of Classification Search
CPC ..... F04D 29/124; F04D 29/10; F04D 29/102; F04D 29/104; F04D 29/121; F04D 29/122; F02C 6/00
See application file for complete search history.

(56) References Cited

U.S. PATENT DOCUMENTS

| | | | | |
|---|---|---|---|---|
| 2012/0043727 | A1 | 2/2012 | Alfes | |
| 2013/0170961 | A1* | 7/2013 | Meucci ..... | F01D 25/22 415/170.1 |

FOREIGN PATENT DOCUMENTS

| | | | | |
|---|---|---|---|---|
| CN | 101285555 | A | | 10/2008 |
| CN | 201650839 | U | | 11/2010 |
| CN | 102066766 | A | | 5/2011 |
| DE | 4216006 | C1 | | 4/1993 |
| DE | 4225642 | C1 | | 7/1993 |
| DE | 4239586 | | * | 1/1994 |
| DE | 4239586 | C1 | | 1/1994 |
| DE | 102009012038 | A1 | | 9/2010 |
| DE | 102011003173 | A1 | | 7/2012 |
| EP | 0570086 | A1 | | 11/1993 |
| EP | 1207310 | A1 | | 5/2002 |
| WO | WO 2012117016 | A1 | | 9/2012 |

OTHER PUBLICATIONS

Chinese Office Action Dated Sep. 29, 2015; Application No. 201380056221.4; 12 pgs.
International Search Report PCT/EP2013/069921; International Filing Date: Sep. 25, 2013; 2 pgs.

* cited by examiner

PROCESS GAS COMPRESSOR/GAS TURBINE SECTION

CROSS-REFERENCE TO RELATED APPLICATIONS

This application claims priority to PCT Application No. PCT/EP2013/069921, having a filing date of Sep. 25, 2013, based on DE 102012219520.3 having a filing date of Oct. 25, 2012, the entire contents of which are hereby incorporated by reference.

FIELD OF TECHNOLOGY

The following relates to a process gas compressor/gas turbine section, in which the process gas compressor is provided to compress combustible process gas.

BACKGROUND

A process gas compressor has a housing and a rotor which is accommodated in the housing. The rotor has a shaft which is mounted at the longitudinal ends thereof outside the housing. As a result, the shaft passes at the longitudinal ends thereof through the housing, wherein the shaft is sealed there from the housing by a shaft seal. The inside of the process gas compressor is therefore separated from the atmosphere. The construction of the shaft seal is conventionally such that a gas separation is arranged first, followed by an oil separation, as viewed from the inside of the process gas compressor. The inside of the process gas compressor, the process side, is separated from the atmosphere by means of the shaft seal and from the bearing region by means of the oil separation. The shaft seal is constructed, for example, as a gas-lubricated rotating mechanical seal which is designed as a tandem seal.

A tandem seal is constructed from two gas-lubricated rotating mechanical seals which each have a sliding ring, which is fastened to the housing, and a counter ring, which is fastened to the shaft. Each sliding ring is arranged axially directly adjacent to the associated counter ring thereof, forming an axial gap. The rings are arranged in the tandem seal in such a manner that the process side is sealed from a flare pressure by the primary seal. The separation from the atmosphere is brought about with the secondary seal, wherein the secondary seal is additionally provided as redundancy to the primary seal in the event of failure of the primary seal. Seal gas which is used for sealing the axial gaps is introduced between the two counter rings. In order to separate the bearing region, a tertiary seal, for example, which can be constructed, for example, as a labyrinth seal or a carbon ring seal, is provided as the oil separation. The tertiary seal is acted upon with a seal gas, as a result of which the sealing of said tertiary seal is brought about.

Process gas can be used as the seal gas for the primary seal, and air or nitrogen can be used for the secondary seal. During the operation of the process gas compressor, leakage gas occurs because of a leakage of the primary seal and the secondary seal. The leakage gas is a gas mixture consisting of the process gas and the seal gas together with air, wherein the leakage gas is conventionally conducted away to the atmosphere or to a flare. These two variants are problematic for the environment by being associated with undesirable emissions to the surroundings. Although the provision of a system for separating the process gas from the leakage gas and for recycling the process gas into the process provides a remedy, such a system is, however, energy-intensive and is associated with high costs.

SUMMARY

An aspect relates to a process gas compressor/gas turbine section which has a low emission loading.

The process gas compressor/gas turbine section according to the embodiment of the invention has a process gas compressor and a gas turbine which is coupled to the shaft of the process gas compressor in order to drive said compressor, wherein the process gas compressor is designed to compress combustible process gas and is equipped to seal the process gas compressor inner chamber from the atmosphere with a shaft seal which can be sealed with a seal gas and which has at least one leakage gas line with which leakage gas can be conducted away from the shaft seal and which is connected to the air inlet of the gas turbine such that the leakage gas together with inlet air at the air inlet can be conducted into the gas turbine during the operation of the process gas compressor/gas turbine section.

The process gas compressor/gas turbine section is designed in such a manner that the leakage gas is supplied to the air inlet of the gas turbine. As a result, the leakage gas is mixed with the inlet air of the gas turbine and enters the compressor of the gas turbine. In the compressor, the air/leakage mixture is compressed and supplied to the combustion chamber of the gas turbine. The flame formed in the combustion chamber comes into contact with the leakage gas, and therefore the process gas portion in the leakage gas is burned in the combustion chamber. As a result, the process gas portion in the leakage gas is thermally utilized in the combustion chamber, and thus helps the driving power of the gas turbine. In addition, the leakage gas does not need to be supplied, for example, to a flare or to the atmosphere, and therefore the emission loading of the environment is reduced.

The shaft seal preferably has a process-side primary seal and an atmosphere-side secondary seal, wherein the primary seal and the secondary seal each have one of the leakage lines. The leakage line for the secondary seal preferably has an atmosphere line and a changeover member which is designed in such a manner that, during the normal operation of the shaft seal, the atmosphere line is connected in a fluid-conducting manner to the secondary seal for conducting leakage gas away from the secondary seal to the atmosphere, and, if the sealing effect of the secondary seal fails, the leakage line is connected in a fluid-conducting manner to the secondary seal for conducting leakage gas away from the secondary seal to the air inlet. It is preferred that the changeover member has a diaphragm in the atmosphere line and a bursting disk in the leakage line between the connection of the atmosphere line to the leakage line and the air inlet. Alternatively, it is preferred that the changeover member is a three-way directional control valve which is arranged at the connection of the atmospheric line to the leakage line.

The shaft seal is preferably a gas-lubricated rotating mechanical seal. It is preferred in this connection that the gas-lubricated rotating mechanical seal is realized in a tandem arrangement. In addition, it is preferred that the process gas compressor is a pipeline compressor.

BRIEF DESCRIPTION

Figure 2:
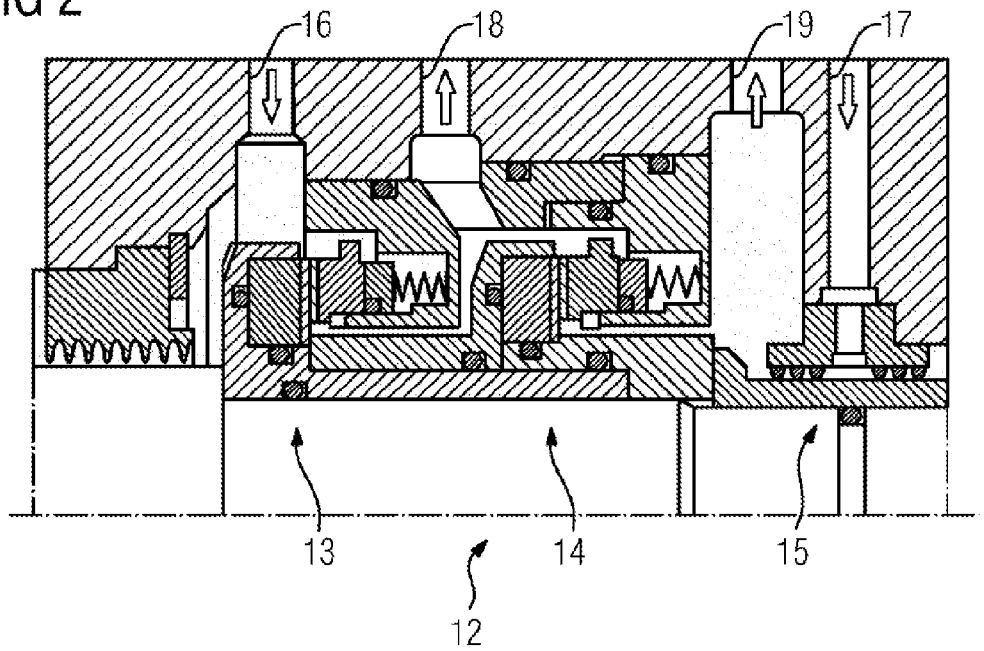

Some of the embodiments will be described in detail, with reference to the following figures, wherein like designations denote like members, wherein:

FIG. 1 shows a flow chart of the embodiment of the compressor/gas turbine section; and FIG. 2 shows a longitudinal sectional illustration of a shaft seal.

DETAILED DESCRIPTION

As is apparent from the figures, a compressor/gas turbine section 1 has a process gas compressor 2 of turbocompressor design and a gas turbine 3. The process gas compressor is, for example, a pipeline compressor for compressing natural gas. The gas turbine 3 has a compressor 5 for compressing inlet air, a turbine 5 for obtaining shaft output and a combustion chamber 6. Furthermore, at the compressor inlet, the gas turbine 3 has an air inlet 7 via which ambient air is conducted to the compressor 4. Exhaust gas is conducted away from the turbine 5 via an exhaust gas outlet 8. The turbine 5 furthermore has a shaft 9 which is coupled by means of a coupling 10 to the shaft of the process gas compressor 2 and thereby drives the process gas compressor 2.

The shaft of the process gas compressor 2 is mounted on both sides by means of bearings 11. In order to seal the interior of the process gas compressor 5 from the atmosphere and from the bearings 11, shaft seals 12 which are realized as gas-lubricated rotating mechanical seals in a tandem construction are provided on the shaft.

The shaft seals 12 each have a primary seal 13, a secondary seal 14 and a tertiary seal 15. The primary seal 13 seals off the process side of the process gas compressor 2 whereas the tertiary seal 15 seals off the bearing 11. The secondary seal 14 is arranged between the primary seal 13 and the tertiary seal 15 and is provided as a support and protection of the primary seal 13. If the primary seal 13 namely fails, the process pressure is first of all applied to the secondary seal 14 and not to the tertiary seal 15 which is conventionally formed by carbon rings and therefore because of the construction would not withstand the process pressure. In addition, the secondary seal 14 prevents the process gas from being able to enter the bearings 11 and therefore the atmosphere if the primary seal 13 fails.

The shaft seal furthermore has a process gas seal line 16 and a seal gas line 17 (the seal gas line differs from the process gas line because of the seal gas which does not have to be process gas and is preferably not process gas). The seal gas line can basically be operated with various gases, wherein inert gas (for example nitrogen) is preferred in some applications. In the process gas seal line 16, process gas is present at a pressure which is somewhat higher than the process pressure present on the process side. In the seal gas line 17, seal gas—optionally inert gas—is present at a pressure which is higher than the atmospheric pressure. The process gas seal line 16 is conducted onto the primary seal 13, and therefore the primary seal 13 is sealed by the process gas. Analogously, the seal gas line 17 is conducted onto the tertiary seal 15 such that the tertiary seal 15 is sealed with the seal gas.

A primary leakage line 18 with which leakage of the primary seal 13 is conducted away from the shaft seal 12 is provided between the primary seal 13 and the secondary seal 14. Owing to the fact that the primary seal 13 is acted upon with process gas, the leakage of the primary seal consists of process gas. Furthermore, a secondary leakage line 19 is provided between the tertiary seal 15 and the secondary seal 14. With said secondary leakage line 19, leakage of the secondary seal 14 and of the tertiary seal 15 is conducted away from the shaft seal 12. Owing to the fact that the secondary seal is acted upon from the primary seal 13 with process gas, the leakage of the secondary seal 14 consists of process gas. In an analogous manner, the leakage of the tertiary seal 15 consists of inert gas. The leakage collected by the secondary leakage line 19 is therefore a mixture of process gas and inert gas.

The primary leakage lines 18 and the secondary leakage lines 19 are conducted to the air inlet 7, and therefore the leakage flows in the primary leakage lines 18 and the secondary leakage lines 19 are supplied to the inlet air of the compressor 4. The leakage gas flows are thereby mixed with the inlet air of the gas turbine 3 and pass into the compressor 4. In the compressor 4, the air/leakage mixture is compressed and supplied to the combustion chamber 6. The flame formed in the combustion chamber 6 burns the process gas portion in the leakage gas. As a result, the process gas portion in the leakage gas is thermally utilized in the combustion chamber 6 and thus helps the driving power of the gas turbine 3.

A shaft seal monitoring system 26 monitors and controls the operation of the shaft seals 12, wherein the operating conditions can correspond to a design operating state or to an off-design operating state. Furthermore, the operation of the gas turbine 3 is monitored and controlled by a gas turbine monitoring system 27. The gas turbine monitoring system 27 preferably has a gas analysis unit with which the composition of the air at the air inlet 7 can be measured. In principle, a gas analysis is not required because the shaft seal monitoring system 26 recognizes on the basis of the turbine load and the leakage at the shaft seals whether the leakage is still safe or not—as described below.

It is conceivable for the primary leakage lines 18 and the secondary leakage lines 19 to be connected to a flare 20 via a valve 22. This creates the option that, by actuation of the valve 22, the leakage flows in the primary leakage lines 18 and the secondary leakage lines 19 are not supplied to the air inlet 7, but rather to the flare 22. In the flare 22, the process gas portion of the leakage flows is burned and the resulting combustion products are emitted into the atmosphere.

The conducting away of the leakage gas flows to the flare 20 is necessary, for example, whenever an ignitable mixture would form in the compressor 4 because of the introduction of the process gas leakage into the air inlet 7. This should absolutely be avoided since there is the risk here of the flame penetrating from the combustion chamber 6 through the compressor 4. For this purpose, the gas analysis unit with which the igniting risk in the air inlet 7 and in the compressor 4 can be measured is provided at the air inlet 7. If, during the operation of the compressor/gas turbine section 1, it is determined by the gas analysis unit that there is an impermissibly high ignition risk, the valve 22 is actuated by the gas turbine monitoring system 27, as a result of which the leakage flows are conducted to the flare 20 instead of into the air inlet 7.

It is conceivable that the secondary leakage lines 19 are additionally connected to a chimney 21 via a valve 25 as a changeover member by means of which the leakage gas flows in the secondary leakage lines 19 can be conducted away to the atmosphere. Downstream of the connection of the chimney 21 and before the air inlet 7, a further valve 24 is installed as a further changeover member in the secondary leakage line 19. Furthermore, an additional valve 23 is installed between the integration of the flare 20 into the primary leakage line 18 and the air inlet 7.

The valves 22 to 25 are activated by the shaft seal monitoring system 27 such that leakages in the primary leakage line 18 and the secondary leakage line 19 can be supplied to the air inlet 7 in coordination with the currently prevailing operating state. The valves 22 and 23 and also the valves 24 and 25 can in each case be designed as a three-way directional control valve.

The valve 24 could be designed as a bursting disk and the valve 25 as a diaphragm. If the primary seal 13 and the secondary seal 14 fail, the process pressure penetrates to the secondary leakage lines 19. Pressure dissipation via the chimney 21 is prevented by means of the diaphragm 25, and therefore the bursting disk 24 bursts. The secondary leakage lines 19 are therefore connected to the air inlet, as a result of which the leakage gas flows in the secondary leakage lines 19 are supplied for thermal utilization not by the chimney 21 but rather to the air inlet 7.

The fuel consumption of the process gas compressor 3 during use as a pipeline compressor for natural gas is typically 200 kg/MWH of natural gas. The fuel/air ratio is typically 1:10. The process gas leakage rate of the shaft seal is typically 5 to 10 kg/hour. The power of the gas turbine 3 is typically 10 MW, wherein the process gas portion in the air inlet flow is approx. 0.05%. The process gas compressor/gas turbine section 1 is typically switched off when the leakage rate of one of the shaft seals 12 is five times the value in relation to the normal operating state. In this case, the process gas portion in the air inlet flow is approx. 0.5%. For safety reasons, the process gas portion in the air inlet flow is monitored by the gas analysis unit.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A process gas compressor/gas turbine section comprising a process gas compressor, and a gas turbine which is coupled to a shaft of the process gas compressor in order to drive the process gas compressor, wherein the process gas compressor is designed to compress combustible process gas and, for sealing a process gas compressor inner chamber from the atmosphere, wherein the process gas compressor/gas turbine section is equipped with a shaft seal which can be sealed with a seal gas, wherein the shaft seal has a process-side primary seal and an atmosphere-side secondary seal, wherein the primary seal and the secondary seal each have a leakage line, wherein the leakage line for the secondary seal has an atmosphere line and at least one valve to facilitate changeover such that, during the normal operation of the shaft seal, the atmosphere line is connected in a fluid-conducting manner to the secondary seal for conducting leakage gas away from the secondary seal into the atmosphere and, when the sealing effect of the secondary seal fails, the secondary seal conducts leakage gas away from the secondary seal to the air inlet through the secondary seal leakage line.

2. The process gas compressor/gas turbine section as claimed in claim 1, wherein the at least one valve to facilitate changeover includes a valve as a diaphragm in the atmosphere line and a valve as a bursting disk in the secondary seal leakage line between the connection of the atmosphere line to the leakage line and the air inlet.

3. The process gas compressor/gas turbine section as claimed in claim 1, wherein the at least one valve to facilitate changeover is a three-way directional control valve which is arranged at the connection of the atmosphere line to the secondary seal leakage line.

4. The process gas compressor/gas turbine section as claimed in claim 1, wherein the shaft seal is a gas-lubricated rotating mechanical seal.

5. The process gas compressor/gas turbine section as claimed in claim 4, wherein the gas-lubricated rotating mechanical seal is realized in a tandem arrangement.

6. The process gas compressor/gas turbine section as claimed in claim 1, wherein the process gas compressor is a pipeline compressor.

7. The process gas compressor/gas turbine section as claimed in claim 6, wherein the gas-lubricated rotating mechanical seal is realized in a tandem arrangement.

8. The process gas compressor/gas turbine section as claimed in claim 2, wherein the process gas compressor is a pipeline compressor.

* * * * *